US005123372A

United States Patent [19]

Kobayashi et al.

[11] Patent Number: 5,123,372

[45] Date of Patent: Jun. 23, 1992

[54] LADDER ARRANGEMENT FOR A WATERCRAFT

[75] Inventors: Noboru Kobayashi; Tomoyoshi Koyanagi, both of Iwata, Japan

[73] Assignee: Yamaha Hatsudoki Kabushiki Kaisha, Iwata, Japan

[21] Appl. No.: 661,124

[22] Filed: Feb. 27, 1991

[30] Foreign Application Priority Data

Mar. 2, 1990 [JP] Japan ..... 2-52299

[51] Int. Cl.[5] ..... B63B 17/00

[52] U.S. Cl. ..... 114/362; 182/70

[58] Field of Search ..... 114/362, 85; 182/48, 182/49, 51, 70, 93, 107, 194, 196

[56] References Cited

U.S. PATENT DOCUMENTS 4,293,967 10/1981 Ord ..... 114/85

4,989,691 2/1991 Wilkerson ..... 114/362

*Primary Examiner*—Jesus D. Sotelo

*Attorney, Agent, or Firm*—Bacon & Thomas

[57] ABSTRACT

Apparatus for assisting in boarding or alighting a watercraft having a hull and a deck is disclosed and includes a ladder which is movable between a stowed position, in which it overlies a portion of the deck, and a deployed position in which it extends from the watercraft forwardly and downwardly of the deck to a landing area in order to assist in boarding or alighting the watercraft. The ladder is attached to the watercraft at a forward location thereof. In one embodiment, the ladder is pivotably mounted by means of a pair of spaced brackets to the deck of the watercraft. In another embodiment, the ladder is slidable within a pair of spaced mounting brackets and is adapted to engage a clip, attached to each mounting bracket, to enable the ladder to pivot to its deployed position. In a third embodiment, the ladder includes a pair of hinged sections with one of the sections being pivotably mounted to the deck at a forward location of the watercraft so that the second pivot can be located forward of the bow of the watercraft to enable the second section of the ladder to extend to the landing area when the ladder is in its deployed position. For use with each of the above described embodiments, the deck of the watercraft includes a recessed area in which the ladder lies when it is in its stowed position. In addition, various projections, which are longitudinally spaced with respect to the watercraft, are provided in the recessed area and are disposed between cross-pieces of the ladder when in its stowed position so as to locate the ladder and provide a stepping area for the occupants of the watercraft.

19 Claims, 4 Drawing Sheets

Fig. 1
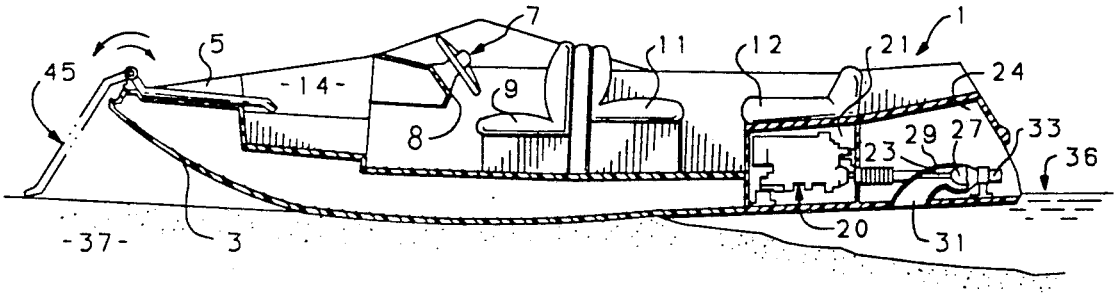
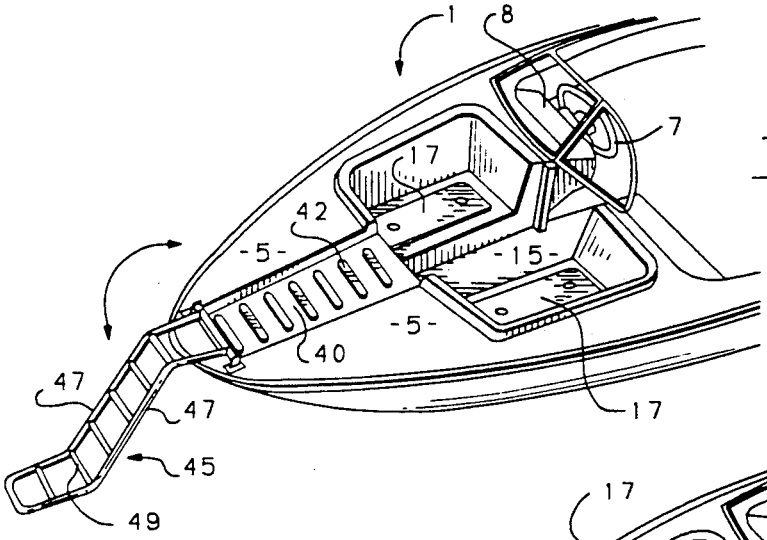
Fig. 2a
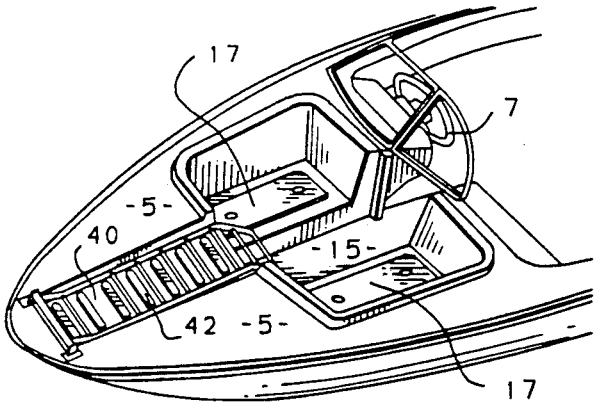
Fig. 2b

Fig. 3
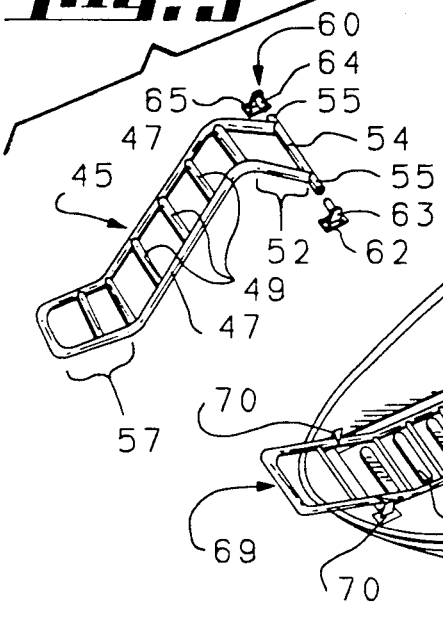
Fig. 4
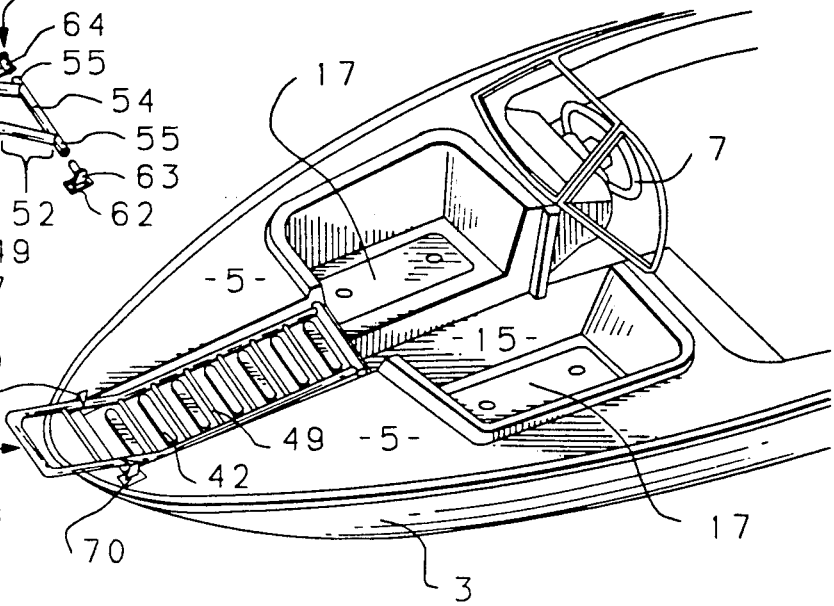
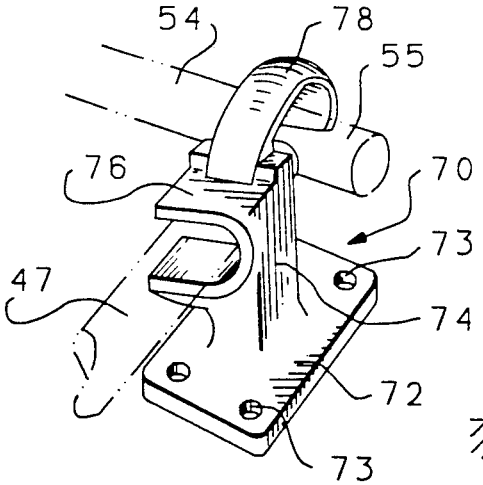
Fig. 5
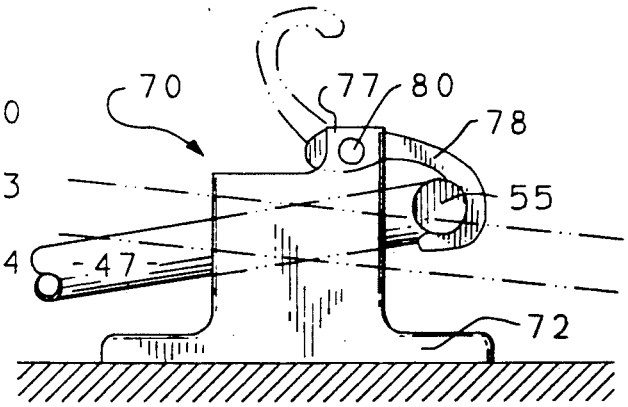
Fig. 6

Fig. 9
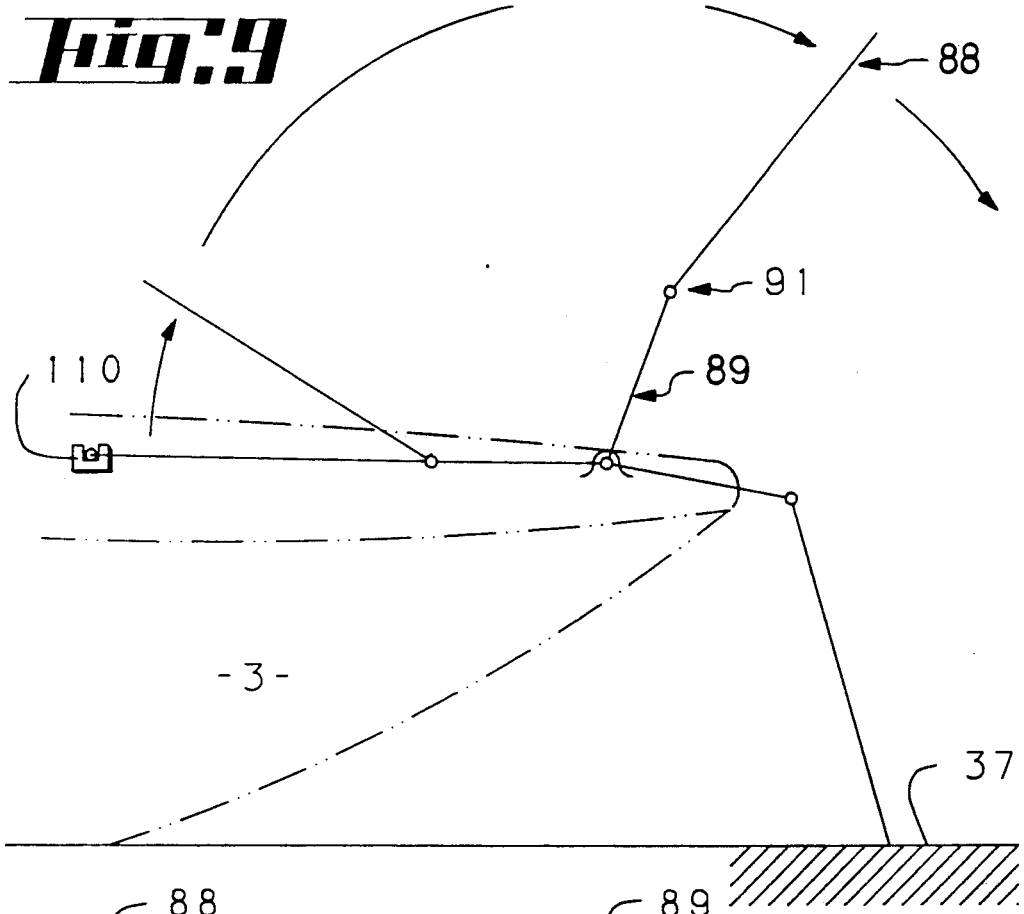
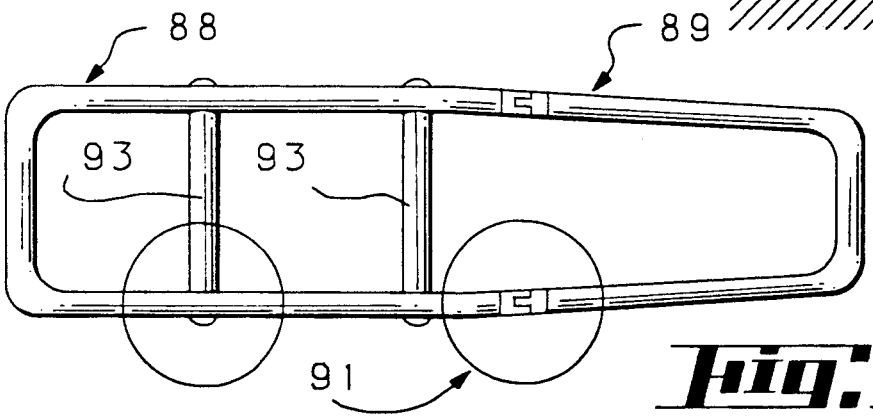
Fig. 10
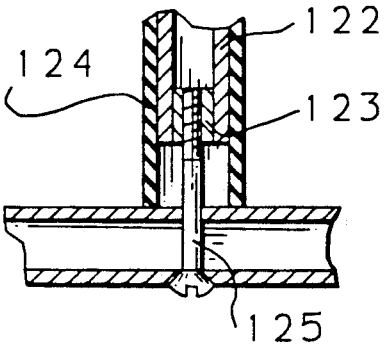
Fig. 11
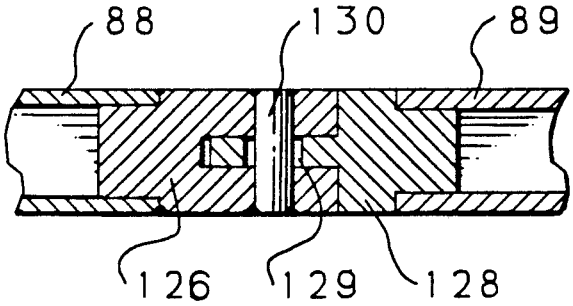
Fig. 12

LADDER ARRANGEMENT FOR A WATERCRAFT

BACKGROUND OF THE INVENTION

The invention is directed to an apparatus for assisting in boarding or alighting small watercraft. More specifically, the invention pertains to a ladder arrangement for use with small watercraft for enabling boarding and alighting the craft when it is beached.

Small watercraft propelled by water jet propulsion units or small outboards are well known. Generally, these units permit the operation of watercraft in a more shallow water than conventional shaft driven propeller crafts. This invention has particular utility for jet propulsion type watercraft and will be described in such context, although the invention could have application in any small watercraft that could be boarded or alighted while it is beached. For movement over the water surface, water jet propulsion driven watercraft are propelled by sucking water through a water inlet and ejecting the water rearward of the watercraft's stern through a jet nozzle by means of an impeller rotating within a flow passage or a suitable pump.

Since the propulsion units on jet propelled watercraft do not extend downward from the hull of the craft a distance generally associated with conventional shaft and propeller driven craft, jet propelled watercraft can be run upon beaches instead of moored to piers or wharfs. However, when on the beach, it is awkward to board or alight the watercraft since the top of the hull is above the ground a distance. Smaller watercraft, such as sport jet propulsion units, can be difficult to board at a wharf or quay, since they do not receive a boarding plank very well and there is no room to store special boarding gear. For this reason, such vessels are awkward to board or alight at a wharf or quay.

It is therefor the object of the present invention to provide an apparatus for assisting in boarding and alighting small watercraft while it is beached and which makes it easy to get on and leave the watercraft while the apparatus is permanently secured to the watercraft.

SUMMARY OF THE INVENTION

The invention pertains to ladder for assisting the boarding and alighting a watercraft. The ladder is particularly adapted for a watercraft having a hull and a deck wherein the deck preferably has secured thereto a mounting bracket arrangement to which the ladder may be secured so as to be pivotably movable between a stowed position in which a substantial portion of the ladder overlies the deck and a deployed or operative position in which the ladder extends from the front portion of the watercraft. The mounting bracket provides a pivot axis for the proximal end of the ladder that extends athwartship. In one embodiment, the ladder is pivotally mounted between a pair of laterally spaced mounting brackets so as to be movable between its stowed and deployed positions. In another embodiment, the ladder is slidable within the mounting brackets and the brackets include clips which are adapted to engage an end portion of the ladder to limit the ladder's movement and aid in supporting the ladder. In a third embodiment, the ladder is pivotally secured to the deck by mounting brackets and the ladder itself is formed from two sections which are pivotally interconnected to enable the ladder to be manipulated into its deployed position. In each of the embodiments, the deck of the watercraft preferably is provided with a recess in which a substantial portion of the ladder lies when in its stowed position. The ladder preferably includes two spaced longitudinal rails interconnected by various cross-pieces. The recess also preferably includes various projections which are spaced in the longitudinal direction of the watercraft and become located between the various cross-pieces when the ladder is stowed.

BRIEF DESCRIPTION OF THE DRAWINGS

FIG. 1 shows a longitudinal cross-sectional view of a jet propelled watercraft embodying a preferred ladder assembly according to a first embodiment of the invention;

FIG. 2*a* shows a top view of a front portion of the watercraft as shown in FIG. 1 with the ladder in its deployed position;

FIG. 2*b* shows a top view of a watercraft similar to that shown in FIG. 2*a* except with the ladder shown in its stowed position;

FIG. 3 shows and exploded view of the ladder and mounting arrangement according to the first embodiment of the invention;

FIG. 4 shows a top view of a watercraft similar to that shown in FIG. 2*b* wherein a ladder according to a second embodiment of the invention is mounted upon a watercraft in stowed position;

FIG. 5 shows a detailed perspective view of one end of the mounting arrangement of the ladder according to the second embodiment;

FIG. 6 shows an enlarged side view of the mounting of the ladder to the watercraft according to the second embodiment of the invention;

FIG. 9 is a schematic representation of the assembly according to the third embodiment as it is moved between its stowed and deployed positions;

FIG. 10 is a perspective view of the ladder according to the third embodiment;

FIG. 11 is a cross-sectional view depicting the interconnection of the ladder rails and cross-pieces according to the third embodiment of the invention; and, FIG. 12 is a cross-sectional view taken at a pivoting joint portion of the ladder rails in the third embodiment.

DETAILED DESCRIPTION OF PREFERRED EMBODIMENTS OF THE INVENTION

Figure 7:
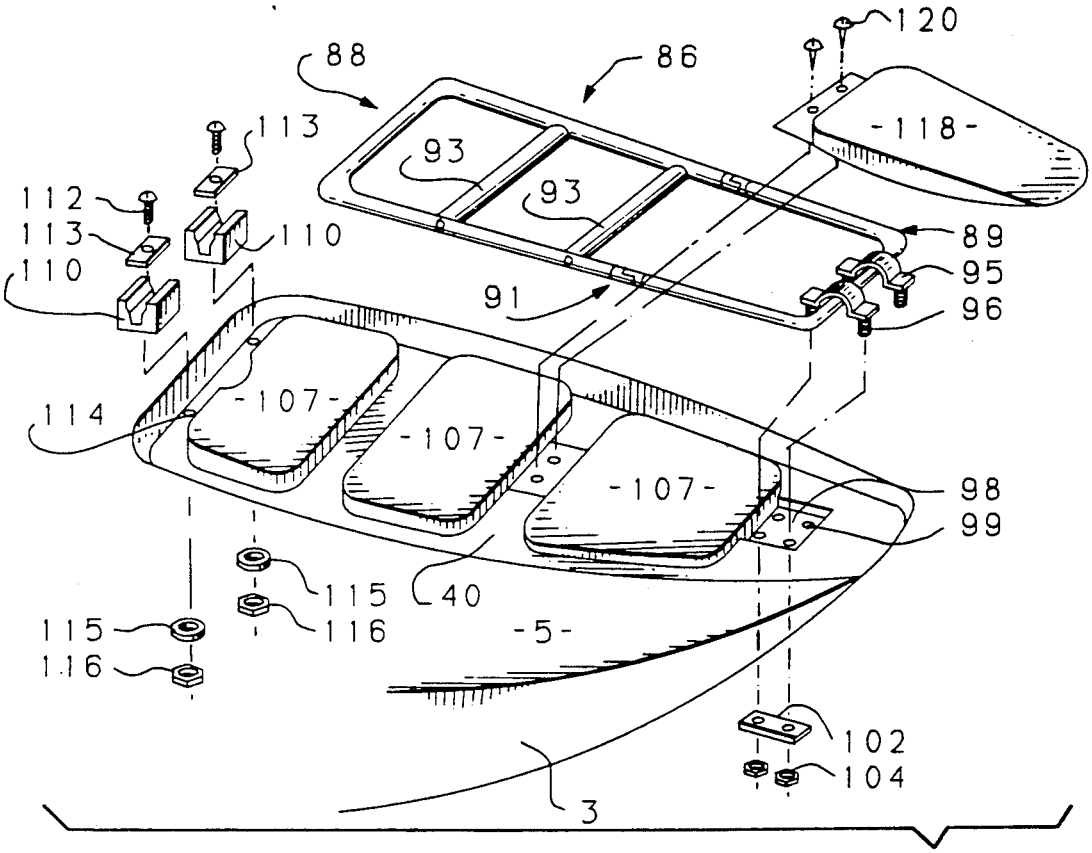
FIG. 7 shows an exploded view of a ladder assembly according to a third embodiment of the invention.

The invention deals with a watercraft generally indicated at 1 in FIGS. 1 and 2*a* having a hull 3 and an upper deck 5, each of which are preferably made of fiber reinforced plastics. The watercraft includes a steering handle assembly 7 which extends from a dash panel 8 in front of an operator seat 9 and function to steer the craft in a manner known in the art. Additional passenger seats 11, 12 are also provided rearward of operator seat 9. Forward of dash panel 8 is located a front passenger area 14 which may be accessed by means of walkway 15. Front passenger area 14 includes additional front seating areas indicated at 17 in FIG. 2*a*.

Watercraft 1 is propelled by means of an engine 20 located within an engine compartment 21 shown to be located beneath the aft passenger seat 12. Engine 20 drives a shaft 23 located within rear drive compartment 24. Secured to and rotatable with shaft 23 is an impeller 27 which is located within a duct 29. Duct 29 extends from a water inlet area 31 to an outlet nozzle 33. As is known in the art, rotation of impeller 27 by means of engine 20 forces water to be sucked into inlet 31 and out nozzle 33 in order to propel watercraft 1.

As depicted in FIG. 1, watercraft 1 has been driven upon a beach such that the rear portion of watercraft 1 is located in water, generally indicated at 36, while the front portion of the watercraft 1 is located on land 37. The invention is particularly directed to an apparatus for assisting in boarding or departing from watercraft 1 which will be explained more fully below with initial reference to FIGS. *2a* and *2b*.

Upper deck 5 of watercraft 1 includes a recessed deck area 40. Various projections 42, which are provided in recess deck area 40, are generally spaced along the longitudinal centerline of watercraft and extend laterally of the watercraft centerline. Mounted to upper deck 5, forward of recessed deck area 40, is a ladder generally indicated at 45.

As best shown in FIG. 3, ladder 45 includes longitudinal side rails 47 which are interconnected by various cross-pieces 49. Ladder 45 includes an upper bent portion 52 terminating in an elongated cross-piece 54 having ends 55 which extend beyond side rails 47. Ladder 45 also includes a lower portion 57 which is bent in a direction opposite to that of upper bent portion 52 for the reasons which will be explained more fully below.

In order to mount ladder 45 upon upper deck 5 watercraft 1, preferably a pair of laterally spaced mounting brackets 60 are utilized. Each mounted bracket 60 includes a base 62, an upright flange 63 and a sleeve portion 64. Mounting brackets 60 include various holes 65 for fixedly securing the brackets to deck 5 by any means known in the art such as screws, bolts, rivets, etc. Mounting brackets 60 are secured to upper deck 5 such that sleeve portions 64 on each mounting bracket 60 extend inwardly towards the longitudinal centerline of watercraft 1. Sleeve portions 64 receive respective ends 55 of elongated cross-piece 54 and thereby define a pivot axis extending athwartship about which ladder 45 may rotate.

By this mounting arrangement, ladder 45 can assume an operative position as shown in FIG. *2a* wherein ladder 45 extends from upper deck 5 downward to a landing area or a stowed position as depicted in FIG. *2b* wherein the ladder 45 is located within recessed area 40 on upper deck 5. When in its operative or deployed position as shown in FIG. *2a*, upper bent portion 52 of ladder 45 directs ladder 45 downward towards the landing area while lower bent portion 57 provides an increased land engaging area for ladder 45. When in its stowed portion as depicted in FIG. *2b*, upper bent portion 52 directs ladder 45 such that rails 47 and cross-pieces 49 extend into recessed deck area 40 with projections 42 extending upwardly between the various cross-pieces 49. Furthermore, lower bent portion 57 extends downwardly into front passenger area 14 so as to remain in an out of the way position and provide for a more aesthetically appealing arrangement. Since projections 42 extend between cross-pieces 49, these projections 42 provide for a substantially continuous upper deck area 5 for access purposes.

It should be understood that any suitable mounting arrangement for the proximal end of the ladder that secures same to the hull while providing generally transverse or athwartship pivot axis could be utilized in accordance with this invention.

FIGS. 4–6 represent a second embodiment of the invention and depict a ladder 69 for use on watercraft 1. Ladder 69 is substantially identical to ladder 45 and like reference numerals have been utilized to indicate similar structure which need not be specifically duplicated in the discussion of the second embodiment. It should be noted, however, that ladder 69 differs from the ladder arrangement previously discussed in two respects. First, ladder 69 lacks a bent portion analogous to upper bent portion 52 on ladder 45 as previously discussed and second, ladder 69 is mounted to watercraft 1 in a distinct manner as will be explained more fully below.

For mounting ladder 69 to watercraft 1, mounting brackets 70 preferably are utilized which include a base 72 having various mounting holes 73 and an upright stem 74. Upright stem 74 defines channels which are U-shaped and open toward the longitudinal centerline of the watercraft 1. Upright stem 74 includes a top portion 76 having an extension 77 to which is mounted a latch, in the form of clip 78, by means of a pivot pin 80. Pivot pin 80 defines a horizontal axis about which clip 78 may rotate.

Mounting brackets 70 are fixedly secured upon upper deck 5 adjacent the bow of watercraft 1 in a manner directly analogous to mounting brackets 60 of the first embodiment. As previously stated, the channel defined by upright stem 74 on each mounting bracket 70 is open towards the longitudinal centerline of watercraft 1. Ladder 69 is adapted to be mounted within these channels such that rails 47 may slide therein. Ladder 69 is therefore movable between a stowed position indicated in FIG. 4 wherein the ladder has been slid rearward of watercraft 1 until the lower bent portion of ladder 69 reaches the upright stems 74 of mounting bracket 70 and an operative (deployed) position in which the ladder 69 may be slid within the channels and clips 78 engage ends 55 of elongated cross-piece 54. It should be noted that rails 47 slide within the channels with a fair degree of clearance so as to permit pivoting of ladder 69 as indicated in FIG. 6. Ladder 69 may be moved from its operative position to it stowed position by pivoting of clips 78 about their respective pivot pins 80 such that ladder 69 may be slid rearward to its position represented in FIG. 4. In its stowed position, similar to ladder 45 in the first embodiment, ladder 69 extends into a recessed deck area 40 formed in upper deck 5 and various projections 42 extend between the cross rails 49.

FIGS. 7–12 represent a third embodiment of the invention similar to the first two embodiments in that a ladder 86 is movable between an operative position to assist in boarding or alighting a watercraft 1 and a stowed position in which a ladder lies within a recessed area 40 formed as part of upper deck 5. The specific details of the third embodiment will now be explained in detail with reference to FIGS. 7–12.

FIG. 7 shows an exploded view of the ladder arrangement according to the third embodiment of the invention and depicts a ladder 86 comprised of first and second substantially U-shaped member 88, 89 which are hinged at 91. As shown best in FIGS. 7 and 10, first U-shaped member 88 includes a base portion (not labeled) which is slightly longer than the base portion of second U-shaped member 89 such that the side rails of ladder 86 converge slightly from first U-shaped member 88 to second U-shaped member 89. Also, as depicted in the figures, first U-shaped member 88 includes various cross-pieces 93, the construction of which will be explained more fully hereinafter.

Ladder 86 is pivotally secured to upper deck 5 of watercraft 1 preferably by means of clamps 95. These clamps 95 include integral bolts 96 which extend into holes 99 provided in a clamp recess area 98 within recess deck area 40. Clamps 95 are secured to watercraft 1 by means of elongated washer members 102 and nuts 104. Due to the hinge connection by means of clamps 95 and hinges 91, ladder 86 may pivot at two locations as indicated in FIG. 9 in order to move from a stowed position wherein ladder 86 is located within recessed area 40 to an operative position in which first U-shaped member 88 is adapted to engage a landing area 37, with member 89 straddling opposite sides of the front end of the watercraft 1 as indicated in FIG. 9.

Figure 8:
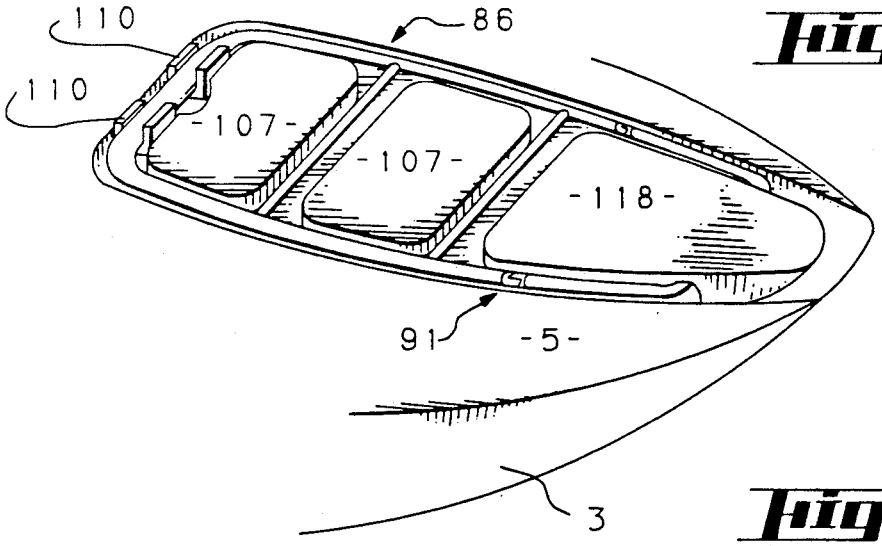
FIG. 8 depicts the ladder according to the third embodiment in its stowed position.

In the third embodiment, recessed area 40 includes various projecting members 107 which, as in the previous embodiments, are adapted to be located between the cross-pieces 93 of ladder 86 when the ladder is in its stowed position. In order to retain ladder 86 in its stowed position, various holding members 110, which are preferably made of rubber, are secured within recessed area 40 by means of bolts 112 which extend through washer members 113, holes 114 in recessed area 40, washers 115 and are engaged by nuts 116. Therefore, when ladder 86 is in its stowed position, the end rail of first U-shaped member 88 may be snapped into resilient holding members 110. In addition, a cover member 118, as best represented in FIGS. 7 and 8, is secured to the upper deck 5 above the foremost projection member 107 and clamps 95 by any suitable means such as screws 120. It should be noted that front projection member 107 is made thinner than the additional two projection members depicted in FIGS. 7 ad 8 such that when ladder 96 is in its stowed position and cover member 118 is secured in place, the combined thickness of the foremost upper projection member 107 and cover 118 is made substantially equal to the thickness of each of the other two projection members thereby providing a substantial level upper deck area 5.

With specific reference to FIGS. 10–12, the particular connection of the cross-pieces 93 to first U-shaped member 88 and the manner in which first and second U-shaped members 88, 89 are hinged together at 91 will be more fully explained. As shown in FIG. 11, each cross-piece 93 includes an inner cross-piece member 122, preferably formed from aluminum or other light weight materials, and includes an integral nut member 123. Cross-piece 93 also includes an outer layer 124, preferably formed from rubber. Cross-pieces 93 are secured to first U-shaped member 88 by means of bolts 125 which extend through the rails of first U-shaped member 88 and are secured to nuts 123.

With specific reference to FIG. 12 and the manner in which first U-shaped member 88 is pivotally connected to second U-shaped member 89, welded or otherwise secured to each of the ends of first U-shaped member 88 is a bifurcated end piece 126. Similarly, welded or integrally secured to each end of second U-shaped member 89 is an end piece having a single central flange generally indicted at 128. End piece 128 includes a bore 129 in its flange through which a pin 130 welded or otherwise secured to bifurcated end piece 126 extends such that first U-shaped member 88 can pivot relative to second U-shaped member 89.

It should be recognized by the above description that each of the described embodiments discloses a ladder arrangement for assisting in boarding and departing from a watercraft which is mounted adjacent the front end of the watercraft and which may be moved between a storage position, in which it lies within a recessed area of the upper deck of the watercraft, and an operative position in which the ladder extends to a landing area. In each of these arrangements a simple and aesthetically appealing arrangement is provided which can greatly enhance the accessibility of the watercraft. It should also be understood, however, that the forms of the invention herein shown and described are to be taken as preferred embodiments of the invention and the various changes and shape, material, size and arrangement may be resorted to without departing from the spirit of the invention or scope of the following claims.

We claim:

1. Apparatus for boarding and alighting a watercraft having a hull and a deck, said deck having mounting means secured thereto at a forward portion of said watercraft, a ladder being attached to said watercraft by said mounting means so as to be movable between a stowed position in which a substantial portion of said ladder overlies said deck and a deployed position in which said ladder extends at least forwardly of the deck, said deck including a recessed area in which a substantial portion of said ladder lies when said ladder is in said stowed position, and said ladder including two longitudinal rails which are interconnected by a plurality of longitudinally spaced cross-pieces, said recessed area including a plurality of longitudinally spaced projections which extend upward from a base portion of said recessed area and project between said cross-pieces when said ladder is in said stowed position.

2. Apparatus as recited in claim 1, wherein said ladder is attached to its mounting means so as to be movable to a position below deck level and forward of the deck.

3. Apparatus as recited in claims 1 or 2, said mounting means includes pivot means secured to a forward portion of said deck, said pivot means providing a pivot axis for one end of the ladder, said axis extending athwartship.

4. Apparatus as recited in claim 3, wherein said pivot means includes bracket means comprising a pair of laterally spaced brackets, each of said brackets including sleeve portions which extend inwardly towards a longitudinal centerline of said watercraft, said one end of said ladder including means received in said sleeves for enabling said ladder to be pivotable between its stowed and deployed positions.

5. Apparatus as recited in claim 3, wherein said pivot means are mounted within a recess provided in the deck of said watercraft.

6. Apparatus as recited in claim 3, wherein said ladder comprises at least two sections which are pivotally interconnected by hinge means.

7. Apparatus as recited in claim 6, wherein said hinge means lies forward of the deck when the ladder is deployed.

8. Apparatus as recited in claim 7, wherein said mounting means is located rearward of the forward end of the deck.

9. Apparatus as recited in claim 6 including ladder holding means secured to said deck and adapted to receive a portion of said ladder to releasably retain said ladder in its stowed position.

10. Apparatus as recited in claim 1 or 2, further including cover means adapted to be secured to said deck and which overlies a portion of said ladder when said ladder is in its stowed position.

11. Apparatus as recited in claim 10, wherein the said ladder portion overlaid by the cover includes said mounting means.

12. Apparatus for boarding and alighting a watercraft having a hull and a deck, said deck having mounting means secured thereto at a forward portion of said watercraft, a ladder being attached to said watercraft by said mounting means so as to be movable between a stowed position in which a substantial portion of said ladder overlies said deck and a deployed position in which said ladder extends at least forwardly of the deck, said mounting means comprising at least two brackets which are laterally spaced with respect to the longitudinal direction of said watercraft, said ladder being slidably mounted between said brackets.

13. Apparatus as recited in claim 12, wherein each of said brackets includes latch means which engage an end portion of said ladder to enable said ladder to pivot about said brackets when said ladder is moved to its deployed position.

14. Apparatus as recited in claim 13, wherein said latch means comprises a pair of clips, each of said clips being pivotally secured to a respective bracket.

15. Apparatus as recited in claim 14, wherein said deck includes a recessed area in which a substantial portion of said ladder lies when said ladder lies when said ladder is in said stowed position.

16. Apparatus as recited in claim 15, wherein said ladder includes two longitudinal rails which are interconnected by a plurality of longitudinally spaced cross-pieces, said recessed area including a plurality of longitudinally spaced projections which extend upward from a base portion of said recessed area and project between said cross-pieces when said ladder is in said stowed position.

17. Apparatus as recited in claim 12, said brackets providing a pivot for the ladder, said pivot rotatable about an axis extending athwartship.

18. Apparatus for boarding and alighting a watercraft having a hull and a deck, said deck having mounting means secured thereto at a position rearward of the forward end of said watercraft, a ladder including a first portion and a second portion angled relative to each other, said first portion of said ladder being attached to said watercraft by said mounting means so that said ladder is movable between a stowed position in which a substantial portion of said ladder overlies said deck and a deployed position in which said first portion of said ladder extends from said mounting means toward said forward end of said watercraft and said second portion is angled from said first portion toward an alighting area.

19. Apparatus for boarding and alighting a watercraft having a hull and a deck, said deck having mounting means secured thereto at a position rearward of the forward end of said watercraft, a ladder being attached to said watercraft by said mounting means so that said ladder is movable between a stowed position in which a substantial portion of said ladder overlies said deck and a deployed position in which said ladder extends at least forwardly of the deck, said ladder including two longitudinal rails which are inter-connected by a plurality of longitudinally spaced cross-pieces, said rails straddling opposite sides of the forward end of the watercraft with said watercraft forward end disposed in longitudinally spaced relationship with adjacent cross pieces of the ladder in the deployed position of the ladder.

* * * * *